United States Patent [19]

D'Amore

[11] Patent Number: 4,733,840

[45] Date of Patent: Mar. 29, 1988

[54] TIE-DOWN SECURITY SYSTEM AND SECURITY PLATE

[75] Inventor: Michael D'Amore, Lake Villa, Ill.

[73] Assignee: Acco World Corporation, Wheeling, Ill.

[21] Appl. No.: 890,704

[22] Filed: Jul. 25, 1986

[51] Int. Cl.[4] ..... E05B 73/00

[52] U.S. Cl. ..... 248/205.3; 70/18; 70/58; 248/551

[58] Field of Search ..... 70/14, 15, 18, 57, 58; 211/4, 5, 6, 7, 8, 9; 248/551-552, 553, 205.3, 221.3, 222.1; 24/304; 16/221, 231

[56] References Cited

U.S. PATENT DOCUMENTS

| | | | |
|---|---|---|---|
| 2,486,032 | 11/1949 | Jimenez . | |
| 3,321,165 | 5/1967 | Wann . | |
| 3,370,446 | 2/1968 | Francis . | |
| 3,564,879 | 2/1971 | Bennett . | |
| 3,613,411 | 10/1971 | Crump . | |
| 3,664,616 | 5/1972 | Raskin . | |
| 3,672,190 | 6/1972 | Palazzolo . | |
| 3,707,860 | 1/1973 | Singer . | |
| 3,743,224 | 7/1973 | Singer . | |
| 3,744,282 | 7/1973 | Hemphill . | |
| 3,765,197 | 10/1973 | Foote . | |
| 3,771,338 | 11/1973 | Raskin . | |
| 3,859,826 | 1/1975 | Singer . | |
| 3,990,276 | 11/1976 | Shontz . | |
| 3,994,148 | 11/1976 | Anderson . | |
| 4,007,613 | 2/1977 | Gassaway . | |
| 4,022,036 | 5/1977 | Cebuhar . | |
| 4,055,973 | 11/1977 | Best . | |
| 4,065,083 | 12/1977 | Gassaway . | |
| 4,065,946 | 1/1978 | Loynes . | |
| 4,074,397 | 2/1978 | Rosin | 24/304 |
| 4,083,620 | 4/1978 | Burgin . | |
| 4,123,922 | 11/1978 | Kuenstler . | |
| 4,300,371 | 11/1981 | Herwick . | |
| 4,361,305 | 11/1982 | Gassaway . | |
| 4,460,143 | 7/1984 | Ohama | 248/359 H |
| 4,577,563 | 3/1986 | Sidler . | |
| 4,579,311 | 4/1986 | Spranza . | |

OTHER PUBLICATIONS

Qualtec securement device.
Theft Guard securement device

*Primary Examiner*—Robert L. Wolfe
*Attorney, Agent, or Firm*—Willian Brinks Olds Hofer Gilson & Lione Ltd.

[57] ABSTRACT

An improved security system for preventing the theft of items, such as typewriters and personal computers. The system has a security plate which is fixed to the item that is to be secured. A bendable member is permanently attached to a center area of a plate base, and has a free end spaced from the center area of the base. A loop is advantageously formed on the free end for attaching the bendable member to a cable, chain or the like used to attach the plate to the anchor. When an attempt is made to forcibly remove the item, the bendable member bends to direct the removal force to the center of the plate where it can be distributed over the entire base and thereby more effectively resisted.

11 Claims, 6 Drawing Figures

TIE-DOWN SECURITY SYSTEM AND SECURITY PLATE

FIELD OF THE INVENTION

This invention is related to systems for securing items to a relatively immobile object or anchor to prevent the theft of such items, and is particularly directed to a fastener that is attached to such items.

BACKGROUND OF THE INVENTION

The present invention improves on theft prevention systems which prevent items from being stolen by securing those items to larger relatively immobile objects (referred to as anchors). For example, the theft of personal computers, typewriters, adding machines, telephones, and other equipment of similar size is a serious problem for many businesses. To solve this problem, various types of "tie-down" security systems have been developed.

One system involves bolting, welding, or otherwise rigidly attaching the item to be secured to an anchor like a desk, table, or wall. While making it difficult to steal the items, this system also prevents any movement or adjustment of the item by a user. For instance, if a typewriter is rigidly attached to a table it would be difficult for a typist to adjust the position of the typewriter to suit the typist's preference.

To allow some movement of the item and at the same time keep the item permanently attached to the anchor, systems using chains or cables have been used. These cable systems have a cable permanently attached at one end to the center of a solid plate, or permanently attached to one of the solid plate's outer edges. The plate is then affixed to the item to be secured, such as with a "double-sticky" adhesive pad. The other end of the cable is then attached to the anchor.

Attaching the cable to the edge of the plate presents a weakness in this type of system. This is because substantially all of the force exerted against the plate as the item is pulled or yanked away from the anchor is isolated along the edge of the plate to which the cable is attached. Only a small fraction of the adhesive pad holding the plate thus effectively opposes the removal force. The plate then acts as a lever, with the end furthest from the point where the cable is attached serving as a fulcrum. The result is that the plate can be peeled away from the item that it is supposed to secure, which obviously reduces the effectiveness of the security system.

The design in which the cable is attached to the center of the plate, although distributing a removal force more evenly over the area of the plate, nevertheless is subject to failure because the cable can be pulled free of the plate. That is, the cable end, which is attached to the plate by bolts, rivets, swedging and the like, can be yanked from the plate. The plate remains attached to the item to be secured, but the item is no longer connected to the anchor.

An additional disadvantage of this center-attached design is that there may not be enough clearance underneath the item to be secured (such as a typewriter or telephone) for the plate. This occurs because the cable and its attachment to the plate protrude from the surface of the plate. Thus, to avoid this problem, the plate would have to be attached to the back, side, or some other readily visible part of the secured item, which is unsightly and undesirable.

SUMMARY OF THE INVENTION

It is a principal objective of this invention to provide a security system for securing items to an anchor, and which incorporates a fastener, or plate, that is easily attached to an item to be secured, that advantageously has a low-profile for attachment beneath the item, and that distributes a removal force over substantially the entire surface of the plate.

To this end, the present invention comprises a tie-down security system including a plate that is attached to the item to be secured, such as by a "double-sticky" adhesive pad. The plate has a bendable member that is permanently attached to a plate base near the center portion of the base. The bendable member has a free end which is spaced from the center portion of the plate. The free end of the bendable member is attached to a cable, for example, such as by a loop formed on the free end through which the cable passes. The cable is then affixed to an anchor, such as the leg of a table.

When someone attempts to forcibly remove the secured item, the bendable member is thereby bent relative to the base. The force exerted on the plate remains directed toward the center of the base, however, thereby bringing the adhesive strength of the entire pad to bear against removal.

In a present form of the invention, the plate has a generally planar base, and is formed out of rigid metal. The bendable member is made integral with the base, such as by stamping. The free end of the bendable member is located at a side edge of the base. A loop or rolled portion is formed in the free end of the bendable member through which a cable or chain is passed, with the cable then secured to an anchor. The plate has a very low profile and is readily attached to the bottom of nearly any object with only the loop showing, if at all.

The foregoing features and advantages of the present invention will be further understood upon consideration of the following detailed description of some embodiments of the invention taken in conjunction with the accompanying drawings, in which:

DETAILED DESCRIPTION OF EMBODIMENTS OF THE INVENTION

Figures 1, 2, 3, 4, 5, 6:
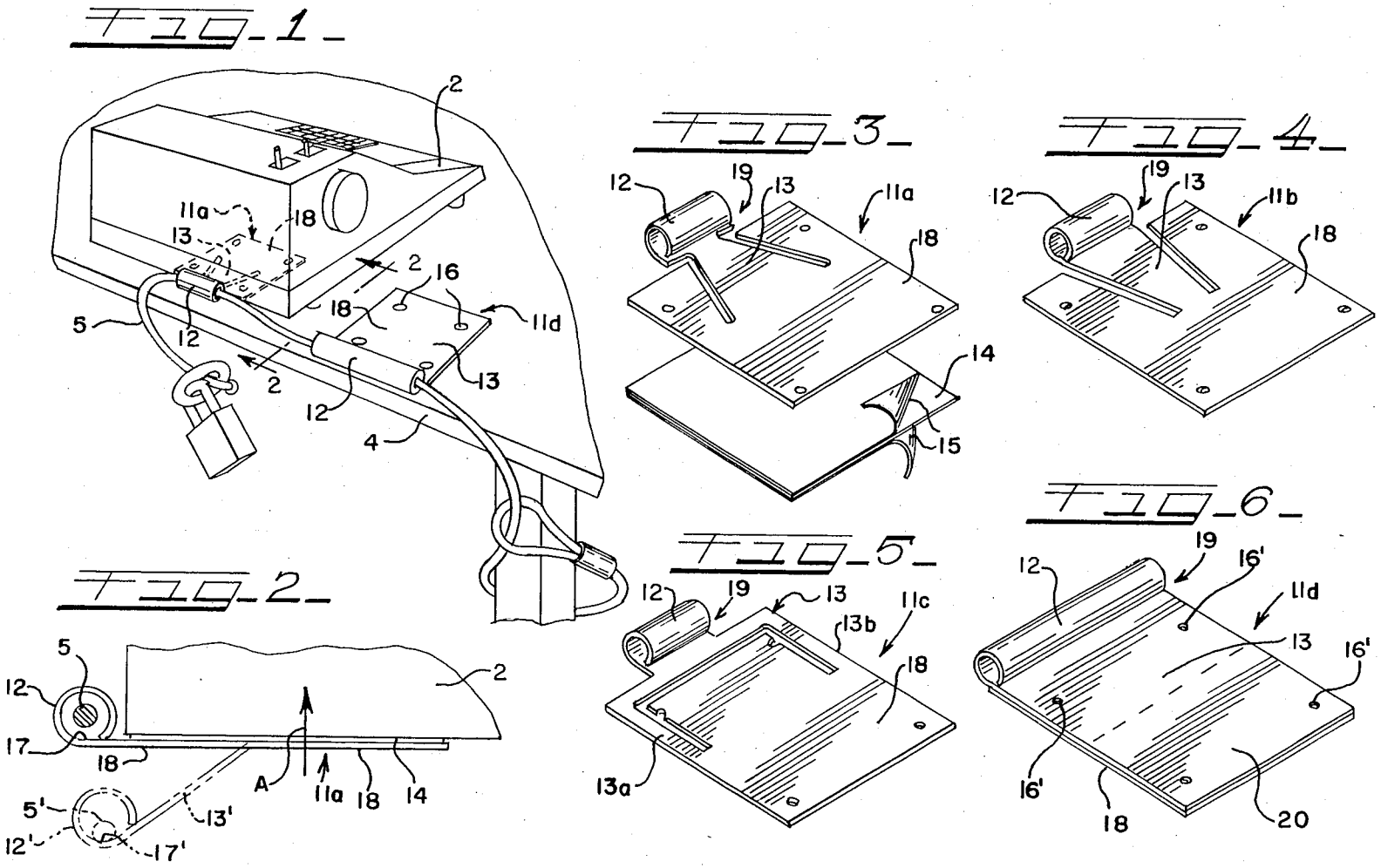
FIG. 1 is a perspective view of a security system embodying security plates made in accordance with this invention.
FIG. 2 is an enlarged sectional view taken along line 2—2 of FIG. 1.
FIGS. 3 through 6 are perspective views of various embodiments of security plates made in accordance with this invention.

A security system embodying security plates made in accordance with the present invention is illustrated in FIG. 1. This system has a security plate 11*a* (of the type depicted in FIG. 3) that is attached to an adding machine 2 which is to be secured against removal. A second security plate 11*d* (of the type depicted in FIG. 6) is attached to an anchor 4, which in this case happens to be a table. A cable 5 is passed through a loop or rolled portion 12 of the security plates 11*a* and 11*d*. The cable 5 is then attached to the table 4 by looping one end around a table leg, and then locking the cable at the other end. The cable 5 thereby cannot be withdrawn from the loop 12 unless the cable is unlocked.

The plates 11*a*–11*d* each have a base 18. Permanently attached to a center area of the base 18 is a bendable member 13. In the embodiments 11*a*–11*c* of FIGS. 3–5, the bendable member is formed integral with the base 18, as by stamping. The FIG. 6 embodiment of the plate (i.e. plate 11*d*) is formed of two sheets welded together along a centerline, and is more fully described hereafter. The plates 11*a*–11*d* are rigid and made of cold rolled steel, although some other material such as plastic could also be employed.

Each bendable member 13 has a free end 19 which is located along one edge of the base 18. The loop 12 is formed on this free end 19.

Taking security plate 11*a* for example, it is attached to the base of the adding machine 2 by means of a double-sided adhesive pad 14. The double-sided adhesive pad 14 has a release paper 15 (FIG. 3) on each side of the pad. In use, the release paper 15 is peeled off one side of the double-sided adhesive pad 14 and that side of the pad is then adhered to one face of the base 18 of the plate 11*a*. The other release paper 15 is thereupon removed, and the plate 11*a* is then pressed against the adding machine with the remaining exposed surface of the adhesive pad 14 adhered to the bottom of the adding machine 2. FIG. 2 shows the double-sided adhesive pad 14 as attached to the plate and adding machine.

An alternative means for attaching the security plate is by using screws 16, as shown with plate 11*d* in FIG. 1. Screws can be used to attach a security plate to an item that is to be secured against removal as well as to a table top, desk or the like.

Once the security plate 11*a* is attached to the adding machine 2, the cable 5 is inserted through the loop 12 and locked. If the adding machine 2 is forcibly moved away from the table 4, as in a direction shown by arrow A in FIG. 2, the security system 1 will oppose that motion, thus preventing removal of the item 2. The movement in the direction of arrow A causes the cable 5 to exert a force against the bottom surface 17 of the loop 12. As this force increases, i.e., as the adding machine 2 is pulled away from the table with greater force, the bendable member 13 will bend as shown in phantom line in FIG. 2. Parts 5′, 12′, and 17′ depict parts 5, 12, and 17 respectively when the bendable member 13 is bent.

As the bendable member 13 is bent, the base 18 remains substantially flat and stays attached to the adding machine 2. The force of removal continues to be directed toward the center of the base 18, however and is distributed over the entire area of the adhesive pad 14. The full benefit of the adhesive pad 14 is thereby achieved. A very sturdy attachment is thus made between the plate and the secured item making the plate highly resistance to removal.

It will also be noted that the plates 11*a*–11*d* present a low profile that enables ready attachment to the underside of nearly any item.

The embodiment of FIG. 3 (plate 11*a*) has a bendable member 13 that widens as it approaches the center area of the base 18. This design will be more resistant to bending and fatiguing than the design of plate 11*b* (FIG. 4), wherein the bendable member 13 has a body that is narrower at the center area of the base 18 than it is at its free end 19.

In the embodiment of FIG. 5, the bendable member 13 is formed by a pair of arms 13*a* and 13*b* which extend into the free end 19.

Yet another embodiment of the present invention is shown in FIG. 6. In this embodiment, the bendable member 13 is formed from a metal sheet 20 that is in facial engagement with the base 18. The bendable member 13 is spot welded along a centerline (dotted in FIG. 6) to the base 18. The metal sheet 20 thus bends along this centerline when a removal force is applied to the loop 12. This embodiment only bends in one direction, and the screw holes 16′ cannot be used if bending is to be effected.

While the invention has been described in connection with a certain presently preferred embodiment, those skilled in the art will recognize modifications to structure, arrangement, portions, elements, materials and components which can be used in the practice of the invention without departing from the principles of this invention.

I claim:

1. A fastener for use in a device for anchoring one or more items against removal comprising:

a base having a center area, means for fixing said base to an item that is to be secured against removal, a rigid member having a portion permanently attached to said base adjacent said center area and a free end spaced from said center area, said bendable member being bendable away from a plane defined by said base, and means for attaching said bendable member free end to an anchor.

2. A security fastener for use in a device for anchoring one or more items against removal comprising:

a generally planar rigid base having a center area, means for fixing said base to an item that is to be secured against removal, a rigid bendable member having a portion permanently attached to said base adjacent said center area and a free end spaced from said center area and adjacent an edge of said base, said bendable member being generally coplanar with said base and bendable away from said base, and means formed on said free end for attaching the fastener to an anchor.

3. The security fastener of claim 2 wherein said bendable member is formed integral with said base and has a body that is wider at said free end than at said portion adjacent said center area.

4. The security fastener of claim 2 wherein said bendable member is formed integral with said base and has a body that is narrower at said free end than at said portion adjacent said center area.

5. The security fastener of claim 2 wherein said bendable member is formed integral with said base and has a pair of arms connecting said free end to said center area.

6. The security faster of claim 2 wherein said bendable member is formed from a second planar plate affixed to said base plate along centerline of said base plate.

7. A device for anchoring one or more items against removal comprising:

an anchor having a portion that is fixed to an anchoring element, a rigid plate having a generally planar base with a center area, means for fixing said base to an item that is to be secured against removal, a bendable member formed integral with said base having one end adjacent said center area and a free end spaced from said center area and located adjacent an edge of said base, said bendable member being generally coplanar with said base and bendable away from said base plate, said bendable member having means formed on said free end for attaching the free end to said anchor.

8. The device of claim 7 wherein said bendable member is formed integral with said base and has a body that is wider at said free end than at said portion adjacent said center area.

9. The device of claim 7 wherein said bendable member is formed integral with said base and has a body that is narrower at said free end than at said portion adjacent said center area.

10. The device of claim 7 wherein said bendable member is formed integral with said base and has a pair of arms connecting said free end to said center area.

11. The device of claim 7 wherein said bendable member is formed from a second rigid planar plate affixed to said base along a centerline of said base.

* * * * *

UNITED STATES PATENT AND TRADEMARK OFFICE

CERTIFICATE OF CORRECTION

PATENT NO. : 4,733,840

DATED : March 29, 1988

INVENTOR(S) : Michael D'Amore

It is certified that error appears in the above-identified patent and that said Letters Patent is hereby corrected as shown below:

Column 3, line 58, "resistance to" should read --resistant to--.

Column 4, line 27, "rigid member" should read --rigid bendable member--;

line 59, "security faster" should read --security fastener--.

References Cited

United Kingdom Patent No. 2,139,963B - 11/21/84 was omitted.

Signed and Sealed this

Eighteenth Day of October, 1988

*Attest:*

DONALD J. QUIGG

*Attesting Officer*

*Commissioner of Patents and Trademarks*